US006517608B2

(12) United States Patent
McDermott et al.

(10) Patent No.: US 6,517,608 B2
(45) Date of Patent: Feb. 11, 2003

(54) PROCESS AND APPARATUS FOR REMOVING PARTICLES FROM HIGH PURITY GAS SYSTEMS

(75) Inventors: Wayne Thomas McDermott, Fogelsville, PA (US); Richard Carl Ockovic, Northampton, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 10/187,342

(22) Filed: Jun. 28, 2002

(65) Prior Publication Data

US 2002/0178911 A1 Dec. 5, 2002

Related U.S. Application Data

(62) Division of application No. 09/602,933, filed on Jun. 23, 2000, now Pat. No. 6,436,170.

(51) Int. Cl.[7] ..... B03C 3/01

(52) U.S. Cl. ..... 95/58; 96/30; 96/88; 96/96; 96/97

(58) Field of Search ..... 95/57, 58, 60, 95/73, 74, 78; 204/164; 96/28, 74, 88, 96, 97, 30; 55/DIG. 38

(56) References Cited

U.S. PATENT DOCUMENTS

| | | | | |
|---|---|---|---|---|
| 1,067,974 | A | 7/1913 | Cottrell | 96/96 X |
| 2,244,278 | A | 6/1941 | White | 96/96 |
| 3,631,655 | A | 1/1972 | Mullen | 55/344 X |
| 3,765,154 | A | 10/1973 | Hardt et al. | 96/97 X |
| 3,768,258 | A | 10/1973 | Smith et al. | 96/97 X |
| 4,072,477 | A | 2/1978 | Hanson et al. | 96/77 X |
| 4,232,355 | A | 11/1980 | Finger et al. | 361/235 |
| 4,247,307 | A | 1/1981 | Chang | 96/97 X |
| 4,376,637 | A | 3/1983 | Yang | 96/28 X |
| 5,199,257 | A | 4/1993 | Colletta et al. | 96/96 X |
| 5,401,301 | A | 3/1995 | Schulmerich et al. | 96/71 |
| 5,409,526 | A | 4/1995 | Zheng et al. | 96/132 |
| 5,707,428 | A | 1/1998 | Feldman et al. | 96/54 |
| 5,766,319 | A | 6/1998 | Kogelschatz | 96/75 |
| 5,980,614 | A | 11/1999 | Loreth et al. | 96/63 |
| 6,129,781 | A | 10/2000 | Okamoto et al. | 96/25 |
| 6,224,653 | B1 | 5/2001 | Shvedchikov et al. | 95/58 |
| 6,228,148 | B1 * | 5/2001 | Aaltonen et al. | 95/74 |
| 6,228,149 | B1 | 5/2001 | Alenichev et al. | 95/78 |
| 6,340,863 | B1 * | 1/2002 | Ikeda et al. | 204/164 X |
| 6,436,170 | B1 * | 8/2002 | McDermott et al. | 95/58 |

OTHER PUBLICATIONS

"*Measurements of Droplet Formation in Withdrawing Electronic Specialty Gases From Liquefied Sources*," Wang, et al, Institute of Envir. Sciences, 1997.

"*Gaseous Effluent Treatment Using A Pulsed Corona Discharge*," Grothaus, et al, IEEE 1995 Pulsed Power Conf., Jul. 1995.

* cited by examiner

*Primary Examiner*—Richard L. Chiesa
(74) *Attorney, Agent, or Firm*—Geoffrey L. Chase

(57) ABSTRACT

An apparatus for removing particles from a gas in a high purity flowing gas system is provided which includes a flow tube inserted inline in the flowing gas system having an inlet and an outlet, a pressure sealed, electrically insulated feed-through integral to the flow tube, an emitter inserted through the feed-through into the flow tube to create a plasma in the gas to charge particles in the gas, and a collector surface in proximity to the emitter; whereby an electric field between the emitter and the collector surface draws the particles in the gas to the collector surface. An apparatus for removing particles from a gas in a high purity gas containment vessel is also provided which includes a gas containment vessel having an inlet orifice, a pressure sealed, electrically insulated feed-through sealingly attached adjacent the inlet orifice, an emitter inserted through the feed-through into the gas containment vessel to create a plasma in the gas to charge particles in the gas; and a collector surface in proximity to the emitter, whereby an electric field between the emitter and the collector surface draws the particles in the gas to the collector surface. Methods of using the above apparatus are also provided.

26 Claims, 5 Drawing Sheets

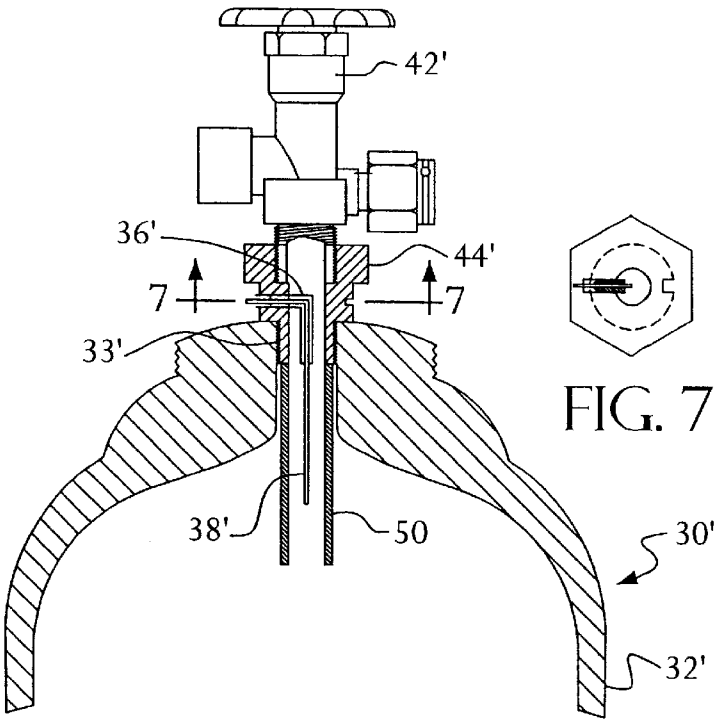
FIG. 6
FIG. 7
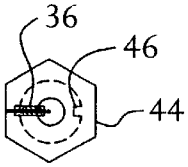
FIG. 5
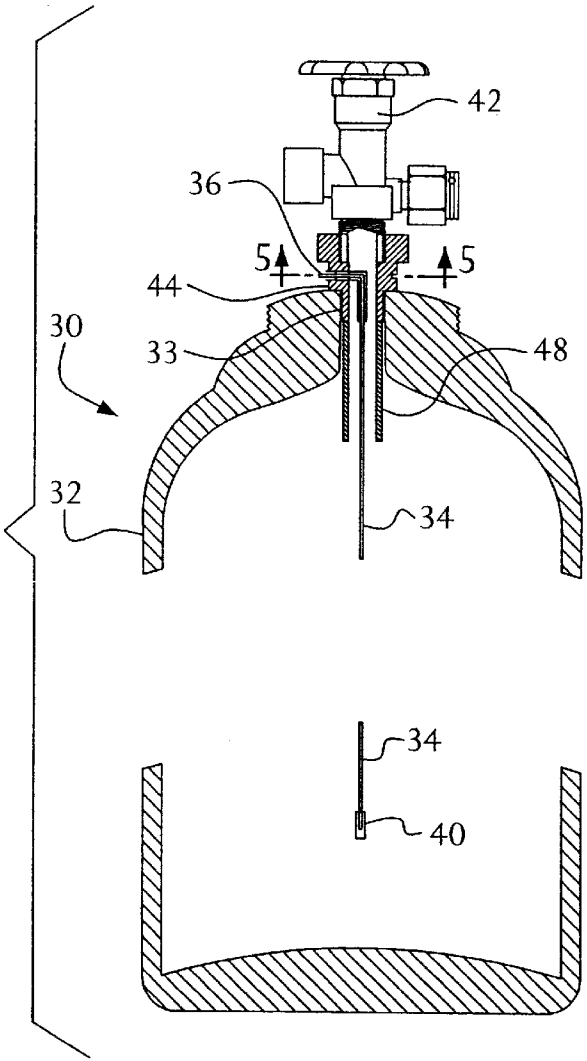
FIG. 4

PROCESS AND APPARATUS FOR REMOVING PARTICLES FROM HIGH PURITY GAS SYSTEMS

CROSS-REFERENCE TO RELATED APPLICATIONS

This application is a divisional application of U.S. application Ser. No. 09/602,933 filed Jun. 23, 2000, and now U.S. Pat. No. 6,436,170.

STATEMENT REGARDING FEDERALLY SPONSORED RESEARCH OR DEVELOPMENT

Not applicable.

BACKGROUND OF THE INVENTION

The present invention is directed to removing particles from high purity gas systems. In particular, the present invention is directed to a process and apparatus for removing particles from high purity gas cylinders and flowing high purity gas systems.

Methods for measuring suspended particles in high purity specialty gas systems for the electronics and semiconductor industries have been developed. However, the sources of particulate contamination in the gases are not currently controlled. Consequently, levels of particulate contamination in recently filled gas cylinders can substantially exceed normally accepted levels for semiconductor processing gases. As used herein, the term "particle" is intended to refer to any unwanted discrete solid or liquid contaminant of any size.

Particle measurements performed on recently filled gas cylinders reveal the following deficiencies. First, the cylinder filling process produces high suspended particle concentrations immediately after fill. Second, the cylinder filling process produces high variability in particle concentrations immediately after fill. Finally, gravitational and diffusive particle settling in recently filled cylinders is very gradual with time. For example, a certification of less than 10 particles per standard cubic foot ($\leqq$0.16 micrometer in size) cannot be achieved in a practical time period following uncontrolled fill. Settling periods on the order of months may be required to achieve such specifications.

The suspended particles in a gas cylinder immediately after fill can originate from four principal sources. First, they may originate in the gas fill system and enter the cylinder suspended in the gas. Second, in the case of reactive gases, they may form within the cylinder through reaction with residual impurities, or by cylinder corrosion followed by particle dislodgment from internal surfaces. Third, they may be released from the cylinder valve during actuation. Fourth, they may be released from the valve and other internal cylinder surfaces by the hydrodynamic shear forces occurring during the fill process. Such shear forces are generally highest at points of flow restriction, such as the cylinder valve, where gas velocities are at the maximum.

Particles originating in the gas fill system can be controlled only through expensive and difficult means, such as clean-up or reconstruction of complete electronics cylinder preparation areas and gas fill systems, and complete revision of all specialty gas fill procedures. Such changes would substantially increase specialty gas production costs and may, in some cases, be economically impractical.

Difficulties with respect to on-site specialty gas distribution systems are as follows.

Certain process gas distribution systems, e.g., gas distribution systems for $WF_6$, $SiCl_4$, $BCl_3$ and HF, among other gases, located at, for example, semiconductor processing facilities are prone to substantial contamination by damaging particles following reaction with residual impurities, such as $H_2O$ and $O_2$, or following particle release from mass flow controllers and other in-line components (shedding). In addition, such low vapor pressure gases, or other gases stored as liquids under their own vapor pressure (e.g., $NH_3$, HCl, $CHF_3$, $C_2F_6$, $C_3F_8$ and $SF_6$) are subject to vigorous liquid boiling in supply cylinders, especially when gas is withdrawn from the cylinder at a high flow rate, as indicated in Wang, Udischas and Jurcik, "Measurements of Droplet Formation in Withdrawing Electronic Specialty Gases From Liquefied Sources" Proceedings, Institute of Environmental Sciences, 1997, p.6–12. Such high flow rate withdrawal to multiple processing tools is common at, for example, modern semiconductor facilities. Low vapor pressure gases are also subject to droplet formation following pressure reduction or cooling in the distribution system. These liquid droplets have been found to be highly stable, and are easily transported through a gas distribution system at near ambient temperature. Furthermore, any evaporated droplets may produce solid or otherwise non-volatile residue particles, which remain suspended in the flowing gas.

However, due to the low source pressure of certain cylinder gases (typically less than 20 psia for $WF_6$, $SiCl_4$, $BCl_3$, and HF, among other gases) such systems require low resistance flow components. Therefore, although compatible filters exist for such chemically reactive gases, any high resistance in-line components would tend to restrict the available flow rate of gas to the semiconductor processing equipment. Filters can also clog under substantial particle or droplet loading, resulting in a progressive restriction of flow through the system and a consequent reduction in operational reliability of the gas system. In-line filtration of these gases is therefore undesirable in most circumstances. Consequently, damaging particles or droplets having highly variable concentrations may be transported to sensitive semiconductor substrates located in the downstream processing tool. Particles and droplets can also reduce the operational lifetimes of mass flow controllers, and other in-line components. Droplets are also responsible for flow fluctuations, severe corrosion, and premature failure of flow delivery components.

Likewise, difficulties in high purity gas cylinders exist. Due to the detrimental effect of particles on, for example, the microchip fabrication process, semiconductor manufacturers require processing gases to meet strict particle specifications (e.g., less than 10 particles per standard cubic foot larger in size than 0.1 micrometer). Such specifications require routine particle testing of flowing bulk gas systems. Current industry trends are toward similar particle specifications on specialty gases packaged in pressurized cylinders. Particle tests are therefore required in pressurized specialty gases after cylinder fill. Depending upon the process gas, such cylinders may contain a single gaseous phase, or combined gaseous and liquid phases, and may have an internal pressure ranging from less than 0 psig to more than 3000 psig.

Methods for measuring particle concentrations in gas cylinders after fill have been developed. These methods permit measurement of suspended particles larger than 0.16 micrometer directly from the gas cylinder at full pressure; no pressure reduction or filtration of the gas is performed in the test.

Although methods for measuring suspended particles in filled gas cylinders have been developed, the sources of particulate contamination in the gas are not currently controlled. Consequently, as described above, levels of particulate contamination in recently filled gas cylinders substantially exceed normally accepted levels for semiconductor processing gases. Also, as described above, the suspended particles in a gas cylinder immediately after fill can originate from several principal sources, and these particle sources can be controlled only through expensive and difficult means. Such changes would substantially increase specialty gas production costs and may in some cases be economically impractical.

There have also been numerous previous attempts to solve the above difficulties. First, with respect to gas cylinder fill systems in flowing high purity gas systems, particles originating in the gas fill system can be controlled using bulk filtration of the entire gas system or at the point-of-fill for each cylinder. However, in some cases, multiple cylinders are filled rapidly from a single source. Flow rates into the cylinders during fill can be high. Therefore, this method requires installation of large capacity filters in the cylinder gas fill manifold. However, due to their substantial pressure drop, under-sized filters may restrict the rate of flow to the cylinders, and therefore increase the required cylinder fill time. An under-sized filter may also be prone to membrane breakage or particle release (shedding) under the high flow velocities occurring during cylinder fill. Also, the gas cylinders are typically evacuated prior to filling to remove gases, suspended particles and other residues remaining from the preparation step. Filters typically have a low vacuum conductance, and are therefore not well suited to vacuum system operation.

Also, a reversal of flow through the filters during evacuation will cause particulate contamination to deposit on the downstream side of a point-of-fill filter. This contamination may then be released back into the gas cylinder when forward flow is applied during the fill process. This problem can only be avoided using a high vacuum-conductance bypass line around the filter. This bypass must be used for reverse flow during the cylinder evacuation step. Such measures increase the complexity and expense of the fill process, and cause a corresponding decrease in operational reliability of the system.

Second, with respect to on-site specialty gas distribution systems in flowing high purity gas systems, low pressure specialty gas distribution systems located at semiconductor fabrication facilities are designed to minimize contamination by particles. Such systems are constructed using high cleanliness, corrosion resistant materials, with minimum dead-legs, external jacketing, and a low rate of leakage. These systems are also carefully purged and dried to minimize residual atmospheric gases prior to use. Heat tracing of cylinders and gas lines is also used to inhibit condensation and droplet formation following pressure reduction or cooling in the system. However, such measures do not guarantee low particle levels during operation. Particle shedding may continue from valves, mass flow controllers, or other in-line components, and reaction may result from residual atmospheric contaminants, system leakage or impurities introduced during cylinder change-out, maintenance, or other operations requiring exposure of the system to atmospheric contamination. Furthermore, such measures cannot fully prevent fine droplets from forming during nucleate or film boiling within cylinders, or following pressure reduction or cooling in the gas system. Such particles and droplets are then free to travel to sensitive semiconductor surfaces during tool operation.

Attempts to solve the above problems with respect to high purity gas cylinders have also been made. First, particles originating in the gas fill system can be controlled using filtration. This fix may be tested by placing a simple point of use filter in-line with the cylinder at the fill point. The cylinder is then pressurized with $N_2$ from the contaminated fill system. This filter effectively removes particles originating from the $N_2$ fill system. However, the initial particle level after fill (471 per standard cubic foot greater in size than 0.16 micrometer) was still unacceptably high for, for example, semiconductor applications. Also, this fix cannot control particles in cylinders which originate from the other sources listed above.

Particles that have been shed from the valve and other internal cylinder surfaces during fill can be substantially reduced using flow control. This fix was may be tested by placing a flow restrictor (and point of use filter) in-line with the cylinder at the $N_2$ fill point. This fix reduces the initial particle level after fill to a level acceptable for, for example, semiconductor applications (4 per standard cubic foot greater in size than 0.16 micrometer). However, this fix is not practical for some cylinder fill applications. For example, in-line flow restrictors may increase the time required to fill gas cylinders. Also, this fix cannot eliminate particles formed within the cylinder through reaction or corrosion.

Particle formation through reaction within the cylinder or by valve actuation can be minimized through appropriate valve design, selection of surface finish, cleaning, preparation and evacuation prior to fill. However, these measures are imperfect, are prone to deterioration through repeated cylinder use or exposure to atmospheric contamination, and do not always result in particle levels suitable for semiconductor applications.

Finally, suspended particles can be removed from the flowing gas as it exits the cylinder using built in filters, mounted on the cylinder valve, see, e.g., U.S. Pat. No. 5,409,526, or conventional in-line filters located in the downstream gas distribution system. However, these devices do not remove particles from suspension in the stored gas. The gas remains contaminated until it flows outward through the valve or settles slowly to a clean condition. Also, such filters may create prohibitively high pressure losses in the flowing gas, especially for such low vapor pressure gases as $WF_6$, $SiCl_4$, $BCl_3$, and HF, among other gases. Such gases require in-line components having low flow resistance.

U.S. Pat. No. 5,409,526 for an apparatus for supplying high purity gas, assigned to Air Products and Chemicals, Inc, provides a gas cylinder having a valve with two internal ports. One internal port is used to fill the cylinder while the other internal port is fitted with a unit that removes particulates and impurities from the gas as the gas leaves the cylinder. The unit includes an inlet, a first filter for removing coarse particulates, layers of adsorbent and absorbent for removing impurities, and a second filter for removing fine particulates. The purified gas leaves the cylinder via the valve after passing through a regulator, a flow control device, tubing and passes through a conventional purifier immediately upstream of the point of use. This apparatus reduces the load on the purifier and decreases the frequency at which the purifier has to be recharged. However, this system uses an entirely different approach to removing particles from the present invention.

U.S. Pat. No. 5,707,428 provides an electrostatic precipitation system that uses laminar flow of a particulate laden gas to enhance the removal of particulates in an air cleaning system. The system includes a housing coupled in fluid communication with a flue. A power source is provided having a first output for supplying a reference potential and a second output for supplying a potential that is negative with respect to the reference potential. The system negatively charges particulates passing through the housing. The charged particulates are collected within the housing by a collecting assembly that form a laminar flow of the flue gas therethrough.

U.S. Pat. No. 5,980,614 provides another air cleaning apparatus that includes an ionizing device having a unipolar ion source formed by a corona discharge electrode, an electrostatic precipitator connected to a high voltage source and having a flow through passageway for air to be cleaned and two groups of electrode elements disposed in the flow through passageway. The electrode elements of one group are interleaved with and spaced from the electrode elements of the other group and arranged to be at a potential different from that of the other group. The corona discharge electrode is arranged such that the ions generated at the electrode can diffuse essentially freely away from the electrode and thereby diffuse substantially throughout the room in which the ionizing device is positioned.

U.S. Pat. No. 3,631,655 is a multiple precipitator apparatus for cleaning gases such as industrial stack effluents that provides a plenum chamber for receiving and distributing gases to be cleaned and a plurality of separately enclosed electrostatic precipitators connected in parallel with each other to the plenum chamber. The plenum chamber distributes the gas flow substantially uniformly among the precipitators.

U.S. Pat. No. 4,232,355 is an ionization voltage source that is adapted to excite a gas-ionization electrode so as to generate copious amounts of ionized gas without producing measurable amounts of undesirable reactive or toxic chemical by-products. The source yields a unipolar voltage wave having a steady state DC component which, though below the ionization potential, serves to condition the gas to promote ionization. Imposed on the steady state component is a gas ionization component in the form of low frequency surges. The duration of the surge pulses is insufficient to break down the gas chemically, but the amplitude thereof is such to effect intense gas ionization.

Grothaus, Michael G., Hutcherson, R. Kenneth, Korzekwa, Richard A., Brown, Russel, Ingram, Michael W., Roush, Randy, Beck, Scott E., George, Mark, Pearce, Rick, and Ridgeway, Robert G., "Effluent Treatment Using a Pulsed Corona Discharge", IEEE 1995 Pulsed Power Conference, Albuquerque, N.Mex., July 1995 teaches a pulsed corona reactor for the abatement of hazardous gases. Here, a series of fast rise time, high voltage pulses are applied to a wire-cylinder geometry resulting in a plethora of streamer discharges within an atmospheric pressure flowing gas volume.

BRIEF SUMMARY OF THE INVENTION

An apparatus for removing particles from a gas in a high purity flowing gas system is provided which includes a flow tube inserted inline in the flowing gas system having an inlet and an outlet, a pressure sealed, electrically insulated feed-through integral to the flow tube, an emitter inserted through the feed-through into the flow tube to create a plasma in the gas to charge particles in the gas, and a collector surface in proximity to the emitter, whereby an electric field between the emitter and the collector surface draws the particles in the gas to the collector surface.

An apparatus for removing particles from a gas in a high purity gas containment vessel is also provided which includes a gas containment vessel, a pressure sealed, electrically insulated feed-through sealingly attached to the gas containment vessel, an emitter inserted through the feed-through into the gas containment vessel to create a plasma in the gas to charge particles in the gas; and a collector surface in proximity to the emitter, whereby an electric field between the emitter and the collector surface draws the particles in the gas to the collector surface.

A method for removing particles from a gas in a high purity flowing gas system is also provided which includes the steps of providing a flow tube inserted inline in the flowing gas system having an inlet and an outlet, providing a pressure sealed, electrically insulated feed-through integral to said flow tube, providing an emitter inserted through the feed-through into the flow tube to create a plasma in the gas to charge particles in the gas, providing a collector surface in proximity to the emitter; and applying a voltage to the emitter or collector surface to produce an electric field between the emitter and the collector surface to draw the particles in the gas to the collector surface.

A method for removing particles from a gas in a high purity gas containment vessel is also provide which includes the the steps of providing a gas containment vessel, providing a pressure sealed, electrically insulated feed-through sealingly attached to the gas containment vessel, providing an emitter inserted through the feed-through into the gas containment vessel to create a plasma in the gas to charge particles in the gas, providing a collector surface in proximity to the emitter; and applying an electric field between the emitter and the collector surface to draw the particles in the gas to the collector surface.

BRIEF DESCRIPTION OF SEVERAL VIEWS OF THE DRAWINGS

FIG. 4 is a partial cross sectional view of an apparatus for removing particles from high purity gas cylinders.

FIG. 5 is a cross sectional view of the apparatus of FIG. 4, taken substantially through lines 5—5 of FIG. 4.

FIG. 6 is a partial cross sectional view of an alternate apparatus for removing particles from high purity gas cylinders.

FIG. 7 is a partial cross sectional view of the apparatus of FIG. 6, taken substantially along lines 7—7 of FIG. 6.

DETAILED DESCRIPTION OF THE INVENTION

Figure 1:
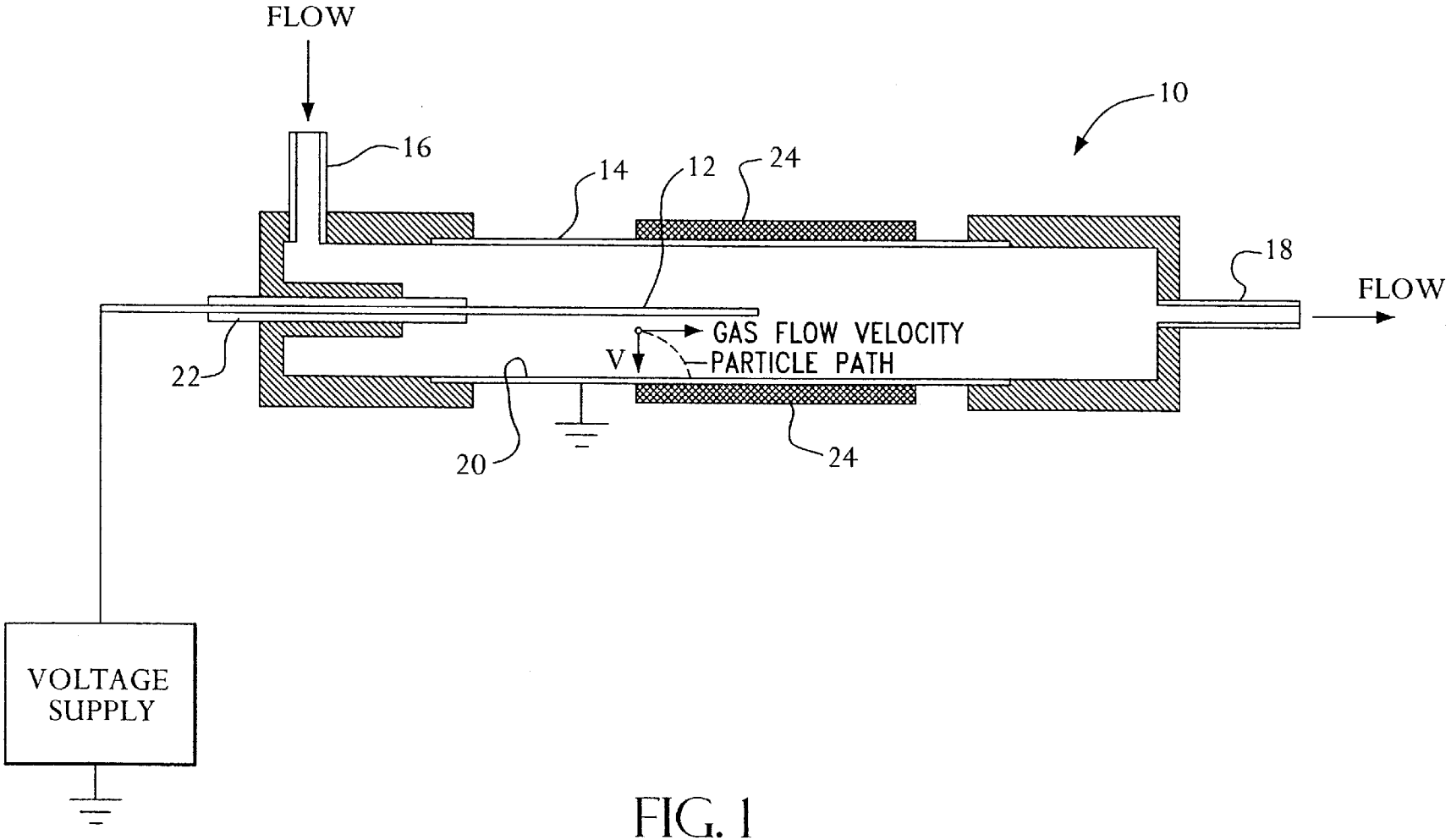
FIG. 1 is a simplified front view of an apparatus for removing particles from a flowing high purity gas system.

In the present invention, suspended contaminant particles are removed from filled gas cylinders or flowing high purity gas distribution systems using electrostatic precipitation. The particles are deposited on an electrically grounded "collector" surface or surfaces which may include the internal surface of the gas cylinder, internal tubing surfaces, or other specially designed surfaces inserted into the gas. The collector surface is located in close proximity to an energized, high voltage electron emitter. The emitter produces a local corona, which permits the gas-borne particles to be charged. The electric field between the emitter and collector then draws the charged particles to the grounded surface. Electrostatic precipitators have been widely used to control particulate pollution from large-scale industrial vent systems, and to clean air in ventilation systems, but have not been applied to cleaning of gases in pressurized containers, such as high purity gas cylinders. Additionally, electrostatic precipitation has not previously been applied to the control of contaminant particles in flowing high purity gas distribution systems such as those used to supply electronics and semiconductor processing equipment. This invention therefore represents a novel application of electrostatic precipitation under substantially different conditions of gas composition and pressure.

FLOWING HIGH PURITY GAS SYSTEMS:

With respect to flowing high purity gas systems, the present invention consists of a means for removing particles from suspension in a gas fill system or specialty gas distribution system through a process of electrostatic precipitation. The contaminant particles or droplets are deposited on a corrosion resistant surface, such as a tube wall. After precipitation, the particles remain attached to the precipitator surfaces by Van der Waals and other strong adhesion forces.

Electrostatic precipitators charge particles by creating a plasma in the gas. The gas molecules are ionized following collision with electrons emitted from the surface of the discharge electrode. The particles are then charged following collisions with the gas ions. This process produces no detrimental effects on the gas or gas system, and produces no significant safety risk when applied to many electronics specialty gases.

Electrostatic precipitation has been widely used to control particulate emissions in large-scale industrial stack effluents, see, e.g., U.S. Pat. No. 3,631,655 and U.S. Pat. No. 5,707,428, in building air ventilation systems, and in small-scale ambient air cleaners (see, e.g., U.S. Pat. No. 5,980,614), but has not been applied to the control of contaminant particles in flowing high purity gas distribution systems such as those used to supply electronics and semiconductor processing equipment. Such new applications of electrostatic precipitation require high purity and, often, corrosion-resistant materials of construction, incorporation of high pressure or vacuum compatible electrical feed-through devices for power sources, unique electrode geometries, consideration to safety in oxidizing or otherwise hazardous gases, and operating parameters consistent with the new gas physical properties.

It should be noted that high energy plasmas can cause chemical breakdown of the gas molecules resulting in unwanted chemical byproducts. Such breakdown has been used advantageously in the abatement of unwanted chemical constituents in gas effluent streams (see, e.g., Grothaus, et. al, "Effluent Treatment Using a Pulsed Corona Discharge", IEEE 1995 Pulsed Power Conference, Albequerque, N.Mex., July 1995). However, in this application, any chemical breakdown of gas molecules is undesirable. This invention is intended to precipitate suspended particles without significant change to the chemical composition of the gas molecules. Such breakdown can be avoided using sufficiently low energy plasmas, or through the use of low frequency voltage surges superimposed on a steady d.c. component as taught by U.S. Pat. No. 4,232,355.

The particle removal rate for industrial scale electrostatic precipitators is typically better than 99.5%. Therefore, depending on the particle challenge to the precipitator, the resulting particle level in the flowing gas should be acceptable for semiconductor applications. The variability of particle concentration reaching the semiconductor processing tool should also be substantially reduced following electrostatic precipitation. The result is a substantially improved consistency in the gas quality at the point of use.

Flow-through electrostatic precipitators can be designed to consist of an essentially hollow tube containing only a low profile electrode. Therefore, electrostatic precipitators have a high vacuum conductance, produce negligible pressure drop under high flow rates, and do not suffer from substantial particle or liquid droplet loading in electronics-grade gas systems. Electrostatic precipitators can also remove particles under a wide range of system pressures, and under reverse flow conditions. As a result, electrostatic precipitators are acceptable for use in systems that must be periodically placed under vacuum, and in low pressure specialty gas distribution systems.

Referring now to the various figures wherein like reference numbers refer to like parts throughout the several views, there is shown in FIG. 1 a simplified embodiment of an apparatus for removing particles from a high purity gas system for a flowing gas system 10. This device is placed in-line in the flowing gas system 10. A centrally located emitter 12, also referred to herein as a "corona wire" or discharge electrode, is connected to a pressure sealed, electrically insulated feed-through 22 in a flow tube 14 having an inlet 16 and outlet 18 in the gas line. This emitter 12 is preferably permanently mounted inside the flow tube 14.

It should be noted that the corona wire (emitter 12) can be charged either positively or negatively in this invention. When negatively charged, the corona wire (emitter 12) can be more appropriately referred to as an emitter or discharge electrode whose function is to emit a high flux of electrons into the surrounding gas, thereby producing a local corona. However, when positively charged, a local corona is similarly formed in the vicinity of the corona wire (emitter 12) due to the high electrical field strength in this region. In either case, the local corona thus formed provides a charge transfer to the particles necessary for subsequent precipitation at the grounded surface, or collector 20.

The emitter 12 can be designed in various geometries not restricted to a thin wire, but intended to enhance formation of a local corona under application of a high voltage. Typical geometries, 12*a*, 12*b*, 12*c*, 12*d*, 12*e*, shown in FIGS. 2*a*, 2*b*, 2*c*, 2*d*, and 2*e* respectively, provide sharp edges, extended surfaces and small radii of curvature to promote high electrical field strength and efficient corona formation, thus enhancing the precipitation process. Such emitter geometries are well known in the art of electrostatic precipitation.

In an alternate embodiment of the invention (not shown), the above referred to "emitter" or corona wire can be grounded, while the alternate "collector" surface can be either positively or negatively charged. In this case, a corona is again formed in the vicinity of the corona wire (emitter 12) due to the high electrical field strength in this region. The corona thus formed provides a charge transfer to the particles necessary for subsequent precipitation. In this embodiment, particles are also attracted to the "collector" surface.

In a typical application of the invention, gas cleaning is accomplished by applying a high d.c. voltage source to a feed-through 22 in the flow tube 14. The rest of the gas system is electrically grounded. The voltage, which is typically in the kilovolt range, must be sufficient to provide corona formation without inducing electrical gap breakdown, or arcing, to the grounded surfaces. Power can be supplied to the emitter 12 continuously during operation in a flow-through precipitator. During operation, the local corona permits the gas-borne particles to be charged. The electric field inside the precipitator then rapidly draws the charged particles to the precipitator surface, or collector 20. Gas can flow in either direction through the tube: the flow direction does not affect the efficiency of the precipitation process.

The subject invention requires installation of electrical feed-throughs and electrodes in specialty gas systems. However, the energy consumption of electrostatic precipitation is typically low, little operating labor or other equipment is required, and the gas cleaning process is very efficient. Also, the polished, high cleanliness internal surfaces of electronics-grade gas systems provide a high conductivity well suited to electrostatic precipitation.

Optionally, the precipitator surface, or collector 20, can be heated using externally mounted heater elements 24, as shown in FIG. 1. Heater elements 24 may consist of, for example, electrical resistance heaters, thermoelectric heater modules, heated fluids in thermal contact with the external surface of the collector surface, or any other method well known in the art of heat exchange. Such heated collector surfaces would aid in vaporization of unwanted liquid droplets as they precipitate onto the surface. Such suspended droplets may be present in vapors flowing at near saturation conditions.

As can be seen in FIG. 1, the electrostatic precipitation process works as follows. The electrical force on a charged particle of radius a in a uniform and steady electric field is equal to the aerodynamic drag force on the particle. The resulting precipitation speed v of the particle in a laminar flow system is given by:

$$v=En_peC/(6\pi\mu a)$$

where $n_p$ is the number of elementary charge units on the particle, e is the elementary unit of charge $=4.803\times10^{-10}$ statcoulomb, E is the electric field strength in statvolts/cm, and $\mu$ is the dynamic viscosity of the gas in poise. C is the Stokes-Cunningham slip correction factor, which is given by:

$$C=1+1.246(\lambda/a)+0.42(\lambda/a)e^{(-0.87\ a/\lambda)}$$

where $\lambda$ is the mean free path of the gas, which depends upon the gas pressure, temperature and composition.

If an emitter and a collector surface are spaced a distance x cm apart, then the time required to precipitate all charged particles is approximately equal to x/v. This is the required exposure time of the flowing gas in order to complete the cleaning process. An effective precipitator must be designed to provide at least this amount of time for the flowing gas in the electric field.

The gas mean free path, the Stokes-Cunningham slip correction factor, and the resulting precipitation speed all tend to vary substantially with gas pressure. Consequently, the exposure time required to complete the precipitation process varies substantially with gas pressure. This pressure effect is important in process gas systems where pressure may vary over orders of magnitude, and significantly distinguishes this invention from the prior applications of electrostatic precipitation described above, which are largely performed at near atmospheric pressure.

Furthermore, the gas dynamic viscosity, the mean free path, and the resulting precipitation speed all tend to vary substantially with gas composition. Consequently, the exposure time required to complete the precipitation process varies substantially with gas composition. This composition effect is important in electronics process gas systems where gas physical properties can vary substantially, and further distinguishes this invention from the prior applications of electrostatic precipitation described above, which are performed predominately, although not exclusively, in air.

It should be noted that many dispersoids, such as dust particles are naturally charged to a degree as a result of their method of formation. However, this charging is usually quite low. Nevertheless, these naturally charged particles may be affected by extended exposure to an electric field, even without additional charging by a corona. Therefore, in an alternate embodiment of the invention, the emitter may also be used as a simple electrode at low voltage levels, insufficient to produce a corona, but sufficient to produce an electric field within the gas system. This electric field will remove a portion of these naturally charged particles from suspension. The particles in this case are deposited on both the grounded surface and the emitter, depending upon the polarity of their natural net charge.

EXAMPLE 1

Figure 2A:
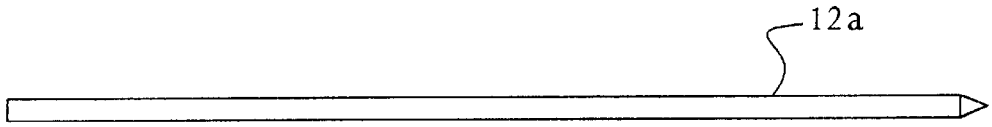
FIG. 2*a* is a simplified front view of an sharpened corona tip emitter for use with the apparatus for removing particles from a flowing high purity gas system of FIG. 1.
Figure 2B:
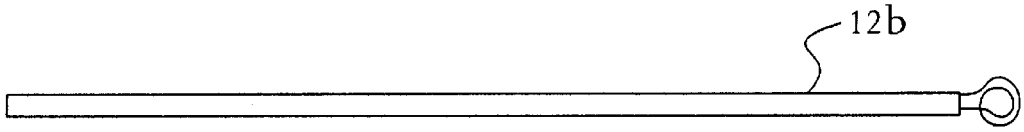
FIG. 2*b* is a simplified front view of an coiled corona wire tip emitter for use with the apparatus for removing particles from a flowing high purity gas system of FIG. 1.
Figure 3:
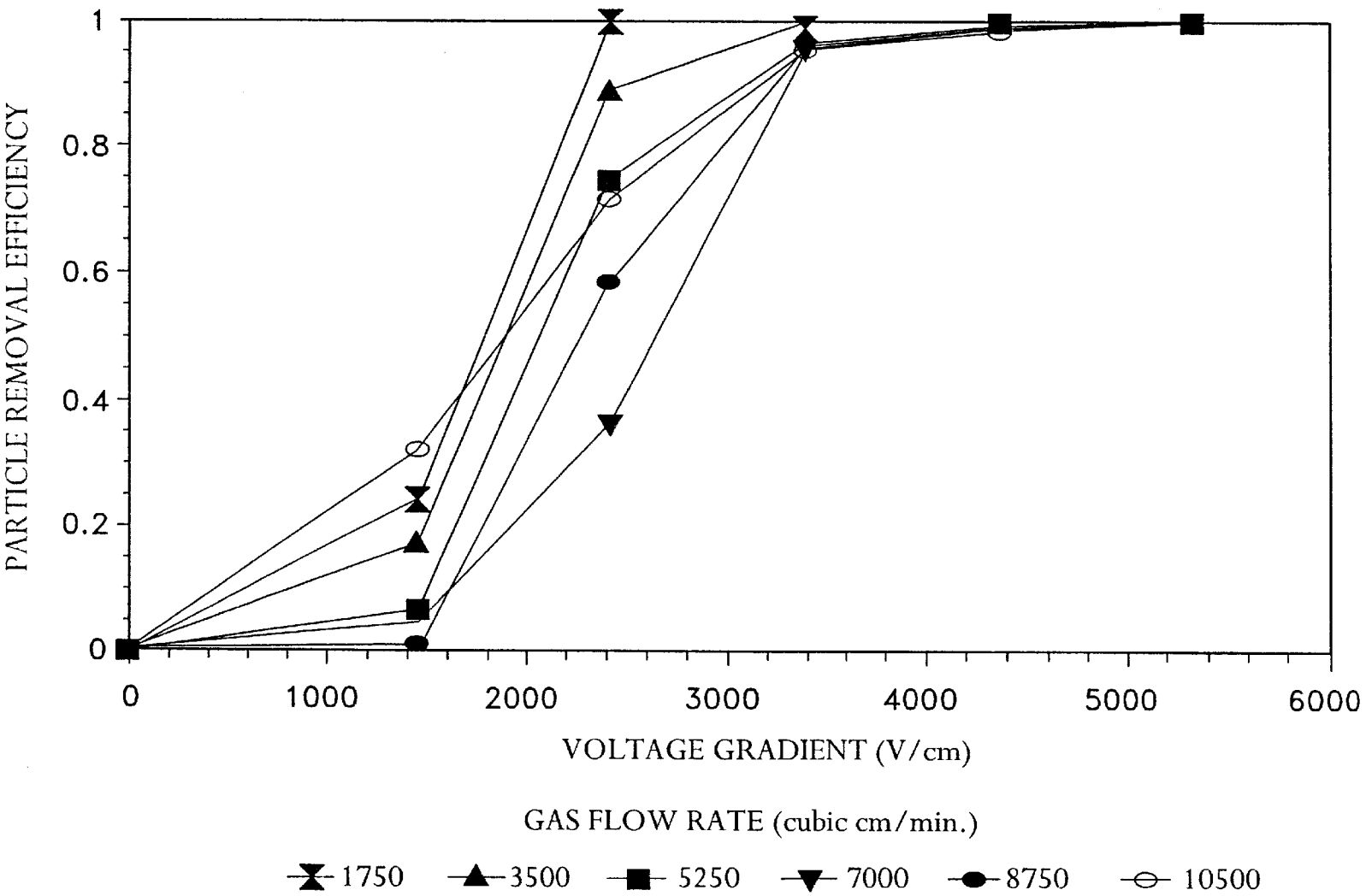
FIG. 3 is a graph of examples of particle removal efficiency vs. voltage gradient (V/cm) at various gas flow rates (cubic cm/min.) when using the apparatus for removing particles from a flowing high purity gas system of FIG. 1.

FIG. 1 shows an apparatus for removing particles from a high purity gas system for a flowing gas system 10 including gas cylinder fill systems and on-site specialty gas distribution systems. The dimensions and operating parameters of this device are provided for illustrative purposes only and may vary substantially among the various applications of this invention. In this example, the electrically grounded metal flow tube 14 had an inside diameter of 4.14 cm, and a length of 64 cm. A 0.159 cm diameter emitter 12 electrode extended 10 cm along the central axis of the flow tube 14. The emitter 12 design consisted of a single conductive rod, as shown in FIG. 2*a*. The spacing between the emitter 12 and the surrounding tube wall, or "inter-electrode spacing", was 1.99 cm. A negative d.c. voltage was applied to the emitter 12. This applied voltage produced an "inter-electrode voltage gradient" between the emitter 12 and the flow tube 14 internal wall. The voltage gradient is equal to the applied voltage divided by the electrode spacing (1.99 cm), and is in units of volts/cm. For this test of the precipitator's performance, air at ambient pressure carrying ambient contaminant particles flowed into the flow tube 14. The concentration of all particles larger than 0.16 micrometer was measured at the outlet of the tube using a continuously sampling particle counter. The ambient air entering the precipitator tube was found to contain about 16 to 110 particles per $cm^3$ (453,000 to 3,110,000 per cubic foot). The resulting particle removal efficiency was then determined under various emitter voltage settings and air flow rates. The results, shown in FIG. 3, demonstrate that the precipitator removed more than 99% of the particles from the air at inter-electrode voltage gradients above 4,000 volts/cm, i.e., d.c. voltages above 8,000 volts. This performance was observed at air flow rates as high as 10,500 $cm^3$/min.

EXAMPLE 2

Figure 2C:
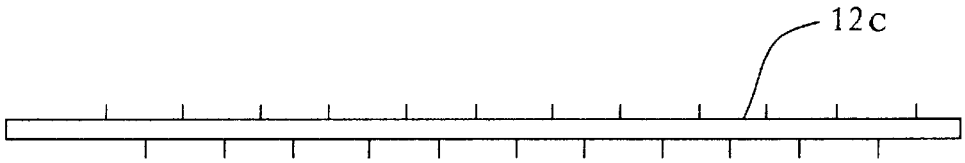
FIG. 2*c* is a simplified front view of an emitter having extended surfaces for use with the apparatus for removing particles from a flowing high purity gas system of FIG. 1.
Figure 2D:
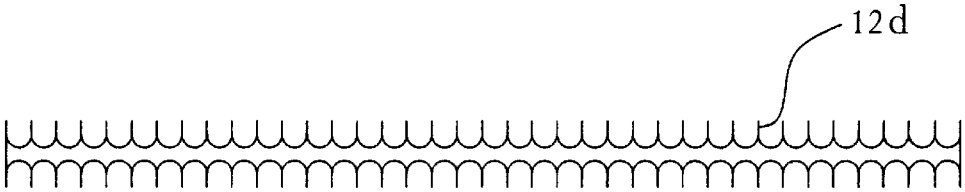
FIG. 2*d* is a simplified front view of an emitter having a serrated edge design for use with the apparatus for removing particles from a flowing high purity gas system of FIG. 1.
Figure 2E:
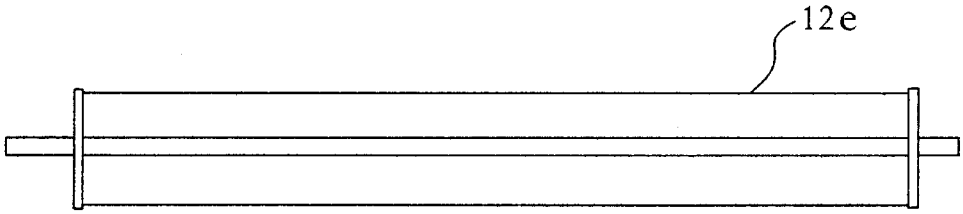
FIG. 2*e* is a simplified front view of an emitter having a mast with corona wires for use with the apparatus for removing particles from a flowing high purity gas system of FIG. 1.

In this example, the electrically grounded metal tube had an inside diameter of 1.65 cm, and a length of 16.2 cm. A 0.159 cm diameter emitter electrode extended 12 cm along the central axis of the flow tube. The emitter design consisted of a single conductive rod with eight filament-like extended surfaces, as shown in FIG. 2*c*. The spacing between the tips of the filament-like extended surfaces and the surrounding tube wall, or "inter-electrode spacing", was 0.349 cm. A negative d.c. voltage was applied to the emitter. This applied voltage produced an "inter-electrode voltage gradient" between the emitter and the tube internal wall. For this test of the precipitator's performance, air at ambient pressure carrying ambient contaminant particles flowed into the tube. The concentration of all particles larger than 0.16 micrometer was measured at the outlet of the tube using a continuously sampling particle counter. The ambient air entering the precipitator tube was found to contain about 11 particles per $cm^3$ (311,000 per cubic feet). The particle removal efficiency of he precipitator was determined under various air flow rates. The precipitator removed all measurable particles from the air at an inter-electrode voltage gradient of 11,500 volts/cm (i.e, a d.c. voltage of 4,000 volts). This performance was observed at air flow rates as high as 3,000 $cm^3$/min.

HIGH PURITY GAS CYLINDERS:

With respect to high purity gas cylinders, the present invention consists of a means for removing particles from suspension in a filled gas cylinder or other gas containment vessel. The microscopic contaminant particles are deposited on the internal surfaces of the cylinder through a process of electrostatic precipitation. After precipitation, the particles remain attached to the cylinder surfaces by the Van der Waals and other strong adhesion forces.

FIGS. 4–5 refer to a preferred embodiment of an apparatus for removing particles from a high purity gas system for a high purity gas cylinder 30. In a cylinder or other gas containment vessel 32, a centrally located emitter 34 is connected to a pressure sealed electrical feed-through 36 preferably in or near the cylinder valve 42. This emitter 34 is located inside the cylinder 32. The emitter 34 consists of a centrally suspended thin corona wire having a small weight 40 attached at its lower end in order to maintain the emitter 34 in a vertical orientation during normal, vertical storage of the gas cylinder 32. In other embodiments of the invention, the emitter may consist of the many emitter geometries known in the art of electrostatic precipitation, including but not limited to those shapes shown in FIGS. 2*a*, 2*b*, 2*c*, 2*d*, and 2*e*. In FIGS. 4–5, the electrical feed-through 36 is installed in a separate, removable pressure sealed fitting placed between the valve 42 and the orifice 33 of the cylinder 32. This design eliminates the need for electrical feed-throughs installed directly in the cylinder valve, and provides easy replacement of the precipitator assembly during routine maintenance of the gas cylinder.

However, other geometries are possible, including incorporation of the electrical feed-through into the cylinder valve or cylinder body itself. Such a geometry has the advantage of eliminating a threaded connection in the system. Such threaded connections increase the chance of external leaks to the cylinder.

The embodiment shown in FIGS. 4–5 includes a ground terminal 46 intended to ensure that the cylinder, acting as a collector surface, is electrically grounded during operation of the precipitator. This embodiment also includes an electrical insulation tube 48 constructed from ceramic or other suitable corrosion resistant material. This tube 48, located near the top of the cylinder and extending into the pressure sealed fitting, surrounds the upper part of the corona wire and acts to prevent electrical arcing to grounded surfaces near the upper, narrow part of the cylinder.

Gas cleaning is accomplished by temporarily connecting a high d.c. voltage source to the feed-through. The rest of the cylinder is electrically grounded. Power is supplied to the emitter for a period of several seconds to several minutes. During this period, the emitter produces a local corona, which permits the gas-borne particles to be charged. The electric field inside the cylinder then rapidly draws the charged particles to the grounded cylinder surface. After completion of the precipitation process, the voltage source is disconnected from the gas cylinder.

As in the flow-through precipitator 10 described above, the corona wire (emitter 34) can be charged either positively or negatively in this invention. When negatively charged, the corona wire (emitter 34) can be more appropriately referred to as an emitter or discharge electrode whose function is to emit a high flux of electrons into the surrounding gas, thereby producing a local corona. However, when positively charged, a local corona is similarly formed in the vicinity of the corona wire (emitter 34) due to the high electrical field strength in this region. In either case, the local corona thus formed provides a charge transfer to the particles necessary for subsequent precipitation at the grounded surface, or collector.

In FIGS. 4–5, the emitter 34 extends to near the bottom of the gas cylinder. This design permits simultaneous cleaning of the entire volume of gas in the cylinder when voltage is applied to the emitter. This design is best utilized when the entire contents of the cylinder are in a gaseous state. However, some cylinders are at least partially filled with liquid. Such cylinders contain a smaller vapor volume above the liquid. In an alternate embodiment of the invention, the emitter may extend only partially down the central axis of the cylinder so that the emitter is not at any point along its length immersed in the liquid. This embodiment permits cleaning of the vapor space above the liquid without shorting of the electric field due to direct contact with liquid. In this embodiment, any liquid droplets suspended in vapors near the saturation point can be continuously deposited on the cylinder wall, without exiting the cylinder.

Such deposited liquid droplets would flow due to gravity down the cylinder wall and into the stored liquid. However, since such liquid-containing cylinders are frequently heat-jacketed during use, any deposited liquid droplets would also tend to vaporize on the heated cylinder surface, thus enhancing the smooth withdrawal of vapor phase from the cylinder. Therefore, in this embodiment, the apparatus 30 is operated continuously during withdrawal of vapor from the cylinder 32. The precipitation process tends to reduce the above described problems associated with transport of stable liquid droplets into the gas distribution system, including flow fluctuations, severe corrosion, premature failure of flow delivery components, and evaporation into solid or otherwise non-volatile residue particles, which remain suspended in the flowing gas.

The subject idea requires installation of an electrical feed-through 36 and an emitter 34 in a cylinder 32. However, the energy consumption of electrostatic precipitation is typically low, little labor or other equipment is required and the gas cleaning process is very rapid. Multiple cylinders can be cleaned simultaneously using a single power source. This cleaning process is completely portable. Cleaning can be performed immediately after cylinder fill, before particle testing, or at any other point, including at the point of use at the semiconductor facility. Also, the polished, high cleanliness internal surfaces of electronics-grade gas cylinders provides a high conductivity well suited to electrostatic precipitation.

Electrostatic precipitators charge particles by creating a plasma in the gas. The gas molecules are ionized following collision with electrons emitted from the surface of the discharge electrode. The particles are then charged following collisions with the gas ions. This process should produce no detrimental effects on the gas or cylinder, and should produce no significant safety risk.

Expressions for efficiency of the precipitation process predict near 100% effectiveness can be achieved for a stationary gas, such as that in a cylinder. Such effectiveness can be achieved following sufficient exposure to the precipitation process. The resulting particle level in the cylinder should therefore be acceptable for semiconductor applications. For example, the precipitation speed v of a particle in quiescent gas system is given by:

$$v=En_peC/(6\pi\mu a)$$

where all parameters are as defined above. If an emitter and a collector surface inside a gas cylinder or other containment vessel are spaced a distance x cm apart, then the time required to precipitate all charged particles is approximately equal to x/v. This is the required exposure time of the quiescent gas in order to complete the cleaning process. An effective precipitator must be designed to provide at least this amount of time for the quiescent gas in the electric field.

As in the flow-through apparatus 10 described above, the gas mean free path, the Stokes-Cunningham slip correction factor, and the resulting precipitation speed all tend to vary substantially with gas pressure. Consequently, the exposure time required to complete the precipitation process varies substantially with gas pressure. This pressure effect is important in gas cylinders where pressure may vary over orders of magnitude, and significantly distinguishes this invention from the prior applications of electrostatic precipitation, which are largely performed at near atmospheric pressure.

Furthermore, the gas dynamic viscosity, the mean free path, and the resulting precipitation speed all tend to vary substantially with gas composition. Consequently, the exposure time required to complete the precipitation process varies substantially with gas composition. This composition effect is important in electronics process gas cylinders where gas physical properties can vary substantially, and further distinguishes this invention from the prior applications of electrostatic precipitation described above, which are performed predominately, although not exclusively, in air.

EXAMPLE 3

FIGS. 4–5 show an electrostatic precipitator designed for pressurized gas cylinders. The dimensions and operating parameters of this device are provided for illustrative purposes only and may vary substantially among the various applications of this invention. In this example, the electrically grounded metal cylinder 32 had an internal volume of about 29,400 $cm^3$, an internal diameter of 19.7 cm, and a total external height of 119 cm. A thin nickel-chromium corona wire (emitter 34) having a diameter of 0.0102 cm was centrally suspended from an electrical feed-through 36. The wire (emitter 34) extended nearly the full length of the gas cylinder 32. A weight 40 at the bottom of the wire (emitter 34) was located about 9.2 cm above the bottom of the cylinder 32. The cylinder 32 was pressurized with particle laden $N_2$ to a pressure of 200 psig. The concentration of all particles larger than 0.16 micrometer was measured at the outlet of the cylinder using a continuously sampling particle counter. The $N_2$ in the cylinder 32 was found to contain about 0.428 particles per standard $cm^3$ (12,100 particles per standard cubic foot). This particle concentration is considered unacceptable for semiconductor processing applications. The cylinder was electrically grounded and an inter-electrode voltage gradient of 1,520 volts/cm (i.e, a negative d.c. voltage of 15,000 volts) was applied to the corona wire (emitter 34) for about 60 seconds. After exposure to the precipitation process, the $N_2$ in the cylinder 32 was found to contain a particle concentration of about $1.127\times10^{-4}$ particles per standard $cm^3$ (3 particles per standard cubic foot). This particle concentration is considered acceptable for semiconductor processing applications. Similar performance was observed under identical test conditions for inter-electrode voltage gradients as low as 800 volts/cm (i.e., a negative d.c. voltage of 8,000 volts), although such low voltages require several minutes to complete the precipitation process.

FIGS. 6–7 show an alternative embodiment of the invention 30'. In this embodiment, the emitter 34' is centrally located in a vertical, electrically grounded collector tube 50. The emitter 34' consists of a sharpened rod as shown in FIG. 2*a*. In other embodiments of the invention, the emitter may consist of the many emitter geometries known in the art of electrostatic precipitation, including but not limited to those shapes shown in FIGS. 2*a*, 2*b*, 2*c*, 2*d*, and 2*e*. In FIGS. 6–7, the complete precipitator apparatus 30', including the electrical feed-through 36', the emitter 34', and the collector tube 50 are installed in a separate, removable pressure sealed fitting 44' placed between the valve 42' and the cylinder 32'. This design eliminates the need for electrical feed-throughs installed directly in the cylinder valve, and provides easy replacement of the precipitator assembly during routine maintenance of the gas cylinder.

Gas cleaning is accomplished by a connecting high d.c. voltage source to the feed-through 36'. The rest of the cylinder 32' is electrically grounded. Power is supplied to the emitter 34' continuously during withdrawal of gas or vapor from the cylinder 32. During operation, the emitter produces a local corona, which permits the gas-borne particles to be charged within the electrically grounded collector tube 50. The electric field inside the collector tube then rapidly draws the charged particles to the grounded tube surface. When gas is not being withdrawn from the cylinder, the voltage source is disconnected from the gas cylinder. This embodiment does not clean the entire volume of the cylinder, but cleans the withdrawn gas flowing out through the collector tube. However, due to the close spacing between the emitter and collector tube in this embodiment, high inter-electrode voltage gradients can be achieved at relatively low emitter voltages. Therefore, particle precipitation can be accomplished at relatively low emitter voltages.

Note that the embodiment of FIGS. 6–7 allows for gas flow entering or exiting the cylinder, i.e., this embodiment can be used to clean incoming gas during the cylinder 32' filling step or outgoing gas. In this case, the apparatus 30' would be operated as gas enters the cylinder 32', and would then be shut-off after cylinder 32' filling is complete. Such operation of the invention would provide a recently filled cylinder containing a predominately particle-free gas.

As in the flow-through apparatus 10 described above, the emitter 34' can be charged either positively or negatively in this invention. When negatively charged, the emitter 34' can be more appropriately referred to as a discharge electrode whose function is to emit a high flux of electrons into the surrounding gas, thereby producing a local corona. However, when positively charged, a local corona is similarly formed in the vicinity of the sharpened emitter tip due to the high electrical field strength in this region. In either case, the local corona thus formed provides a charge transfer to the particles necessary for subsequent precipitation at the grounded surface, or collector.

The apparatus 30' shown in FIGS. 6–7 can be used for either gas-filled or liquid-filled cylinders. For liquid-filled cylinders, any liquid droplets suspended in vapors near the saturation point can be continuously deposited on the collector tube 50, without exiting the cylinder 32'. Such deposited liquid droplets would flow due to gravity down the collector tube 50 wall and return to the stored liquid.

EXAMPLE 4

FIGS. 6–7 shows an apparatus for removing particles from a high purity gas system designed for pressurized gas cylinders 30'. The dimensions and operating parameters of this device are provided for illustrative purposes only and may vary substantially among the various applications of this invention. In this example, the electrically grounded metal cylinder 32' had an internal volume of about 29,400 $cm^3$, an internal diameter of 19.7 cm, and a total external height of 119 cm. An emitter rod 34' having a diameter of 0.159 cm and a sharpened tip was connected to an electrical feed-through 36'. The emitter 34' extended centrally into a 15 cm long electrically grounded collector tube 50 having an internal diameter of 1.75 cm. The cylinder 32' was pressurized with particle laden $N_2$ to a pressure of 200 psig. The concentration of all particles larger than 0.16 micrometer was measured at the outlet of the cylinder using a continuously sampling particle counter. The $N_2$ in the cylinder was found to contain about 2.18 particles per standard $cm^3$ (61,700 particles per standard cubic foot). This particle concentration is considered unacceptable for semiconductor processing applications. The collector was electrically grounded and an inter-electrode voltage gradient of 9,560 volts/cm (i.e, a negative d.c. voltage of only 3,000 volts) was applied to the emitter. During exposure to the precipitation process the withdrawn $N_2$ was found to contain a particle concentration of about 0 particles per $cm^3$. This particle concentration is considered acceptable for semiconductor processing applications.

Figure 9:
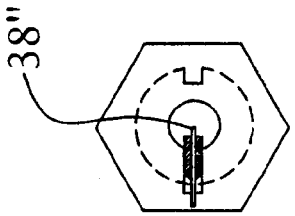
FIG. 9 is a partial cross sectional view of the apparatus of FIG. 8, taken substantially along lines 9—9 of FIG. 8.
Figure 8:
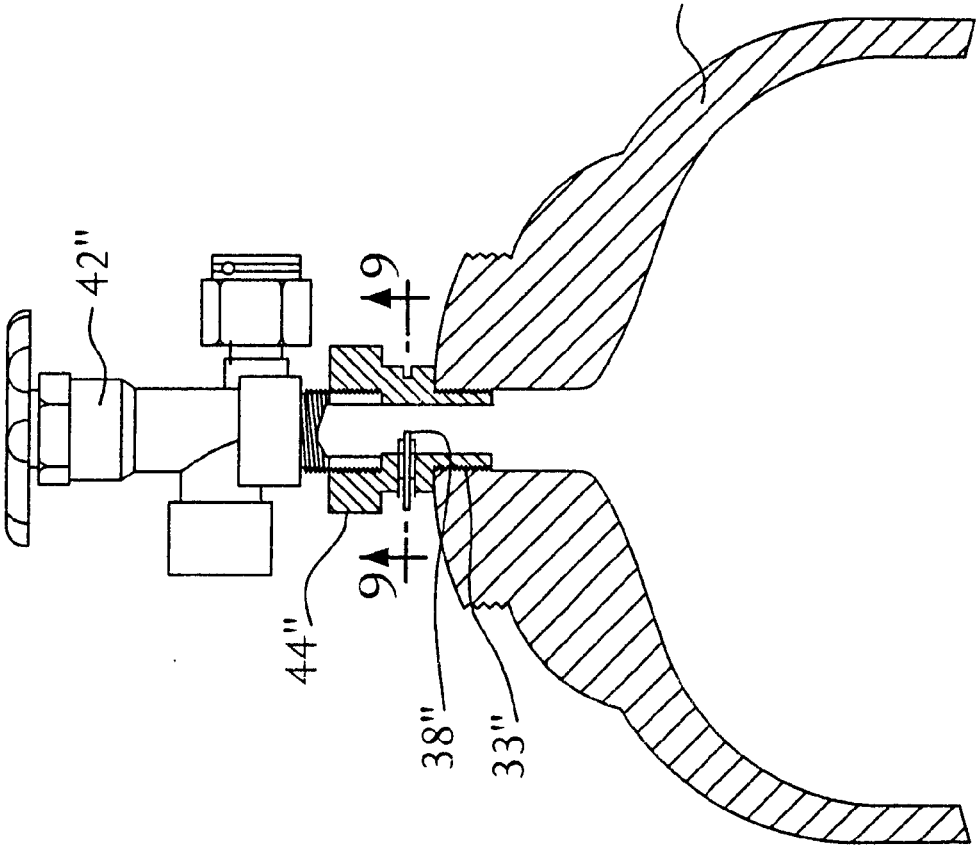
FIG. 8 is a partial cross sectional view of an alternate apparatus for removing particles from high purity gas cylinders.

FIGS. 8–9 show an alternative embodiment 30" of the invention. This embodiment represents a geometrically simpler version of the embodiment shown in FIGS. 6–7. This design provides greater simplicity and lower manufacturing cost than the design shown in FIGS. 6–7. In this case, the vertically oriented collector tube is omitted, and the emitter 34" consists of a horizontally oriented emitter rod 34" having a sharpened tip, as shown in FIG. 2*a*. In this embodiment, the collector surface consists of the electrically grounded pressure sealed fitting 44", gas cylinder 32", and valve 42". Particles and liquid droplets suspended in the withdrawn (or incoming) gas are therefore deposited on these surfaces rather than on a collector tube. Otherwise, this design is operated in the same manner as the embodiment shown in FIGS. 6–7. When used with a threaded, rather than welded, electrical feed-through, the design in FIGS. 8–9 also permits easy removal of the electrical feed-through and emitter rod 34" from the pressure sealed fitting, thus providing easy replacement of worn or damaged emitter rods 34" from the assembly 30". Such emitter 34" replacement can be performed without removal of the valve or the precipitator assembly from the gas cylinder.

It should be noted that many dispersoids, such as dust particles are naturally charged to a degree as a result of their method of formation. However, this charging is usually quite low. Nevertheless, these naturally charged particles may be affected by extended exposure to a relatively strong electric field, even without additional charging by a corona. Therefore, in an alternate embodiment of the invention, the emitter rod may also be used as a simple electrode at lower voltage levels to produce an electric field within the cylinder, and to remove a portion of these naturally charged particles from suspension. The particles in this case are deposited on both the cylinder surface and rod, depending upon the polarity of their natural net charge.

As described above, electrostatic precipitation has been widely used to control particulate emissions in large-scale industrial stack effluents (e.g., U.S. Pat. No. 3,631,655 and U.S. Pat. No. 5,707,428), in building air ventilation systems, and in small-scale ambient air cleaners (e.g., U.S. Pat. No. 5,980,614), but has not been applied to cleaning gases in pressurized containers, such as high purity gas cylinders. Such new applications of electrostatic precipitation require high purity and, often corrosion-resistant materials of construction, incorporation of high pressure or vacuum compatible electrical feed-through devices for power sources, unique electrode geometries, consideration to safety in oxidizing or otherwise hazardous gases, and operating parameters consistent with the new gas physical properties.

In addition, the gas mean free path, the Stokes-Cunningham slip correction factor and the resulting precipitation speed all tend to vary substantially with gas pressure. Consequently, the exposure time required to complete the precipitation process varies substantially with gas pressure. This pressure effect is important in process gas systems where pressure may vary over orders of magnitude, and significantly distinguishes this invention from the prior applications of electrostatic precipitation described above, which are largely performed at near atmospheric pressure.

Furthermore, the gas dynamic viscosity, the mean free path and the resulting precipitation speed all tend to vary substantially with gas composition. Consequently, the exposure time required to complete the precipitation process varies substantially with gas composition. This composition effect is important in electronics process gas systems where gas physical properties can vary substantially, and further distinguishes this invention from the prior applications of electrostatic precipitation described above, which are performed predominately, although not exclusively, in air.

Although illustrated and described herein with reference to specific embodiments, the present invention nevertheless is not intended to be limited to the details shown. Rather, various modifications may be made in the details within the scope and range of equivalents of the claims without departing from the spirit of the invention.

We claim:

1. An apparatus for removing particles from a gas in a high purity gas containment vessel comprising:

(a) a gas containment vessel;

(b) a pressure sealed, electrically insulated feed-through sealingly attached to said gas containment vessel;

(c) an emitter inserted through the feed-through into the gas containment vessel to create a plasma in the gas to charge particles in the gas in the gas containment vessel; and (d) a collector surface in proximity to the emitter;

whereby an electric field between the emitter and the collector surface draws the particles in the gas to the collector surface.

2. The apparatus of claim 1, wherein the gas containment vessel is a gas cylinder.

3. The apparatus of claim 1, wherein the emitter is a corona wire.

4. The apparatus of claim 1, wherein the emitter is positively charged and the collector surface is grounded.

5. The apparatus of claim 1, wherein the emitter is negatively charged and the collector surface is grounded.

6. The apparatus of claim 1, wherein power is applied to the emitter for a desired duration until said particles have precipitated to a desired degree.

7. The apparatus of claim 1 wherein the emitter is a low voltage electrode that does not produce a corona, but does produce an electric field.

8. The apparatus of claim 1, wherein the feed-through is a separate, removable, pressure-sealed fitting between a valve in fluid communication with said containment vessel and said containment vessel.

9. The apparatus of claim 1, wherein the emitter is a wire that extends down the containment vessel without touching any walls of said containment vessel, substantially close to the bottom of the cylinder.

10. The apparatus of claim 1, wherein the emitter extends partially down the containment vessel without touching any walls of said containment vessel.

11. The apparatus of claim 1, wherein the collector surface is a collector tube surrounding at least part of said emitter.

12. The apparatus of claim 1, wherein said emitter is adapted to be energized only during withdrawal of gas from said containment vessel.

13. The apparatus of claim 1, wherein said emitter is adapted to be energized only during insertion of gas into said containment vessel.

14. A method for removing particles from gas in a high purity gas containment vessel comprising the steps:

(a) providing a gas containment vessel;

(b) providing a pressure sealed, electrically insulated feed-through sealingly attached to said gas containment vessel;

(c) providing an emitter inserted through the feed-through into the gas containment vessel to create a plasma in the gas in the gas containment vessel to charge particles in the gas;

(d) providing a collector surface in proximity to the emitter; and (e) applying an electric field between the emitter and the collector surface to draw the particles in the gas to the collector surface.

15. The method of claim 14, wherein the step of providing the gas containment vessel includes providing a gas cylinder.

16. The method of claim 14, wherein the step of providing the emitter includes providing a corona wire.

17. The method of claim 14, wherein the step of applying an electric field includes positively charging the emitter and grounding the collector surface.

18. The method of claim 14, wherein the step of applying an electric field includes negatively charging the emitter and grounding the collector surface.

19. The method of claim 14, wherein the step of applying an electric field includes applying an electric field for a desired duration until said particles have precipitated to a desired degree.

20. The method of claim 14 wherein the step of providing the emitter includes providing a low voltage electrode and wherein the electric field is insufficient to produce a corona, but sufficient to produce an electric field.

21. The method of claim 14, wherein the step of providing the feed-through includes providing a separate, removable, pressure-sealed fitting between a valve in fluid communication with said containment vessel and said containment vessel.

22. The method of claim 14, wherein the step of providing the emitter includes providing a wire that extends down the containment vessel without touching any walls of said containment vessel, substantially close to the bottom of the cylinder.

23. The method of claim 14, wherein the step of providing the emitter includes providing a wire that extends partially down the containment vessel without touching any walls of said containment vessel.

24. The method of claim 14, wherein the step of providing the collector surface includes providing a collector tube surrounding at least part of said emitter.

25. The method of claim 14, wherein the step of providing the emitter includes providing an emitter adapted to be energized only during withdrawal of gas from said containment vessel.

26. The method of claim 14, wherein the step of providing the emitter includes adapting the emitter to be energized only during insertion of gas into said containment vessel.

* * * * *